United States Patent [19]

Young et al.

[11] Patent Number: 4,877,699

[45] Date of Patent: Oct. 31, 1989

[54] ELECTROPHOTOGRAPHIC LUMINESCENT AMPLIFICATION PROCESS

[75] Inventors: Ralph H. Young; John W. May, both of Rochester, N.Y.

[73] Assignee: Eastman Kodak Company, Rochester, N.Y.

[21] Appl. No.: 236,411

[22] Filed: Aug. 25, 1988

[51] Int. Cl.[4] ..... G03G 13/22

[52] U.S. Cl. ..... 430/54; 430/31; 430/139; 250/315.3; 250/362; 250/363.01; 250/459.1; 250/461.1

[58] Field of Search ..... 430/31, 54, 139; 250/315.3, 362, 363.01, 365, 459.1, 461.1

[56] References Cited

U.S. PATENT DOCUMENTS

| | | | |
|---|---|---|---|
| 2,817,767 | 12/1957 | Rosenthal | 430/120 |
| 3,236,776 | 2/1966 | Tomgnek | 430/109 |
| 3,384,565 | 5/1981 | Tulagin et al. . | |
| 3,531,646 | 9/1970 | Kazan . | |
| 3,597,356 | 8/1971 | Diperstein et al. | 252/62.52 |
| 3,788,995 | 1/1974 | Stahly et al. . | |
| 3,954,463 | 5/1977 | Bhagat | 101/426 |
| 3,981,727 | 9/1976 | Nelson et al. | 430/54 |
| 4,070,577 | 1/1978 | Lewis et al. | 430/139 |
| 4,256,820 | 3/1981 | Landa | 430/54 |
| 4,278,884 | 7/1981 | Landa | 118/647 |
| 4,299,904 | 11/1981 | Pettijohn et al. | 430/139 |
| 4,338,614 | 7/1982 | Pressman et al. | 346/155 |
| 4,361,636 | 11/1982 | Isaacson et al. | 430/32 |
| 4,460,907 | 7/1984 | Nelson | 346/153.1 |

*Primary Examiner*—Roland E. Martin

*Attorney, Agent, or Firm*—Thomas H. Close

[57] ABSTRACT

An electrographic luminescent amplification process is described which includes the steps of:

a. forming a low amplitude differential voltage pattern on a photoconductor;

b. developing the low amplitude differential voltage pattern with a luminescent toner to form a luminescent toner image;

c. exciting the luminescent toner image to produce emitted radiation;

d. exposing a photoconductor to the emitted radiation to produce a high amplitude differential voltage pattern on the photoconductor; and e. developing the high amplitude differential voltage pattern to produce a high density image.

19 Claims, 3 Drawing Sheets

ELECTROPHOTOGRAPHIC LUMINESCENT AMPLIFICATION PROCESS

TECHNICAL FIELD

The present invention relates to electrophtography, and in particular to a process for electrographically amplifying an image.

BACKGROUND OF THE INVENTION

The conventional electrophotographic process has an inherently lower gain than the silver halide photographic process. A low exposure in a conventional electrophotographic process results in a low amplitude differential voltage pattern on a photoconductor, and when developed with conventional toner, the resulting toned image has a low density. It has been a longstanding goal to increase the gain of the electrophotograpic process so that higher density images may be produced from low exposures. This is of particular concern in applications such as diagnostic xeroradiography, where the exposing X-rays pose a potential health threat to the patient, and the lowest exposure possible is desired.

In addition to the conventional xerographic process, there are other electrographic processes that produce weak differential patterns of voltage, charge, current, or conductivity and for which increases in gain or photographic speed are desirable. Such electrographic processes include, for example, photoelectrophoresis (see U.S. Pat. No. 4,361,636 issued Nov. 30, 1982 to Isaacson et al.), ionography (see U.S. Pat. No. 4,070,577 issued Jan. 24, 1978 to Lewis et al.), and ion projection (see U.S. Pat. No. 4,338,614 issued July 6, 1982 to Pressman et al.).

It has been proposed to increase the gain of an electrophotographic system, particularly a xeroradiographic system, by amplifying a low amplitude differential voltage image produced by a low X-ray exposure (see U.S. Pat. No. 3,981,727 issued Sept. 1, 1976 to Nelson et al.). In the method of signal amplification taught by Nelson et. al., a low amplitude differential voltage pattern (signal) is developed with an opaque toner. The charged photoconductor, with the image in place, is uniformly illuminated to reexpose the photoconductor using the toned image as a mask. The reexposed image is then further developed by applying additional toner to increase the density range of the image.

Our theoretical studies of the type of signal amplification disclosed by Nelson et al. show that this approach is inherently limited to producing threefold or fourfold increases in gain relative to conventional electrophotography. This conclusion is due mainly to the fact that with low initial exposure the toned image produces a low optical density mask that is somewhat transparent even in the highest density areas. As a result, the photographic speed of the Nelson et al. process is not high. Further increases in the gain of electrophotographic systems are desirable.

It is an object of the present invention to provide a method of amplifying an image in an electrophotographic process and to produce further increases in gain and higher photographic speed thereby. It is a further object of the invention to provide means of amplifying low amplitude voltage, charge, current or conductivity patterns produced by other electrographic methods, such as ionography, stylus recording, ion projection, and photoelectrophoresis.

SUMMARY OF THE INVENTION

The object of amplifying an image in an electrophotographic process is achieved according to the present invention by the following steps. A low amplitude differential voltage pattern is formed on a photoconductor by charging and exposure to a pattern of radiation, such as infrared, visible, ultraviolet, or x-radiation. This differential voltage pattern is developed with a luminescent toner. (Herein, a material is termed luminescent if, when excited by radiation of a first wavelength, it emits radiation of a second, different wavelength. Luminescent materials include phosphors, fluorescent compounds, scintillating compounds, etc.). The luminiscent toner pattern is excited to produce an imagewise pattern of emitted light. A charged photoconductor is exposed to the emitted light to produce a high amplitude differential voltage pattern on the photoconductor. The differential voltage pattern is then developed to produce an image in which the maximum density and the density range are increased many fold compared with the maximum density and density range obtainable by development of the low amplitude differential voltage pattern by conventional means. (Herein, the term density means optical density in conventional modes of viewing, or, in general, any signal dependent upon the coverage of imagewise deposited toner.). The present process is capable of higher gain increases than the amplification method of Nelson et al.

In a preferred mode of practicing the present invention, the low and high amplitude differential voltage patterns are produced and developed on the same photoconductor. The low amplitude differential voltage pattern is produced by a low photoexposure and developed with the luminescent toner. The photoconductor is recharged as necessary. With the luminescent toner image in place, the luminescent toner image is excited to emit radiation that produces the high amplitude differential voltage pattern in the photoconductor. This high amplitude pattern is then developed by conventional means. In one version of this mode, the photoconductor is provided with a filter that blocks the radiation wavelength employed to excite the luminescent toner. In another version of this mode, the photoconductor is transparent to the exciting radiation, so that no filter is required.

According to another mode of practicing the invention, the low amplitude differential voltage pattern is developed with luminescent toner on a first photoconductor, and the developed image is employed to expose a second photoconductor to produce the high amplitude differential voltage pattern. In one version of this mode, the first photoconductor is placed almost in contact with the second photoconductor, and a filter blocking the exciting radiation and passing the emitted radiation is placed between them. In another version of this mode, the luminescent toner image on the first photoconductor is excited, and the emitted light is directed to the second photoconductor by optical imaging means such as a lens.

In yet another version of this mode, the luminescent toner image is transferred to a receiver such as is known in the art, and the luminescence of the transferred image is used to produce a high amplitude differential voltage pattern on a second photoconductor or on the first photoconductor.

The present invention can be used not only in processes using a photoconductor as the image detector, but also in photoelectrophoretic imaging processes such as described in U.S. Pat. No. 3,384,565. Photoelectrophoretic imaging also has inherently a low photographic speed, and it is desirable to improve the sensitivity thereof.

In yet further modes of practicing the present invention, the first luminescent toner image may be produced as the output of any other electrographic process known in the art in which a charge, voltage, current or conductivity pattern is developed by charged toner particles to produce a visible or optically detectable image.

DESCRIPTION OF THE INVENTION

Figure 1:
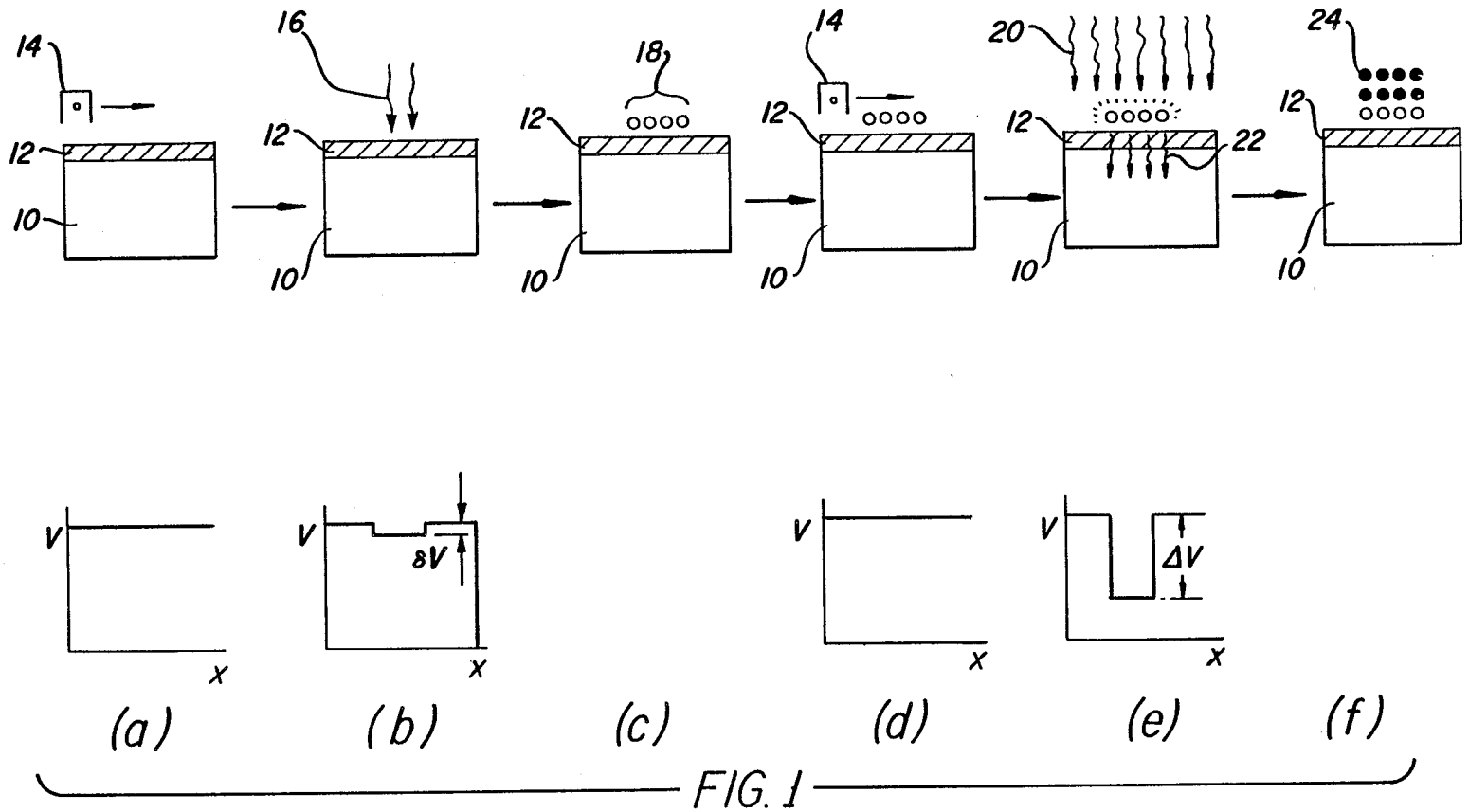
FIG. 1. is a schematic diagram illustrating the steps of the electrophotographic luminescent amplification process according to a preferred mode of practicing the invention.

Referring to FIG. 1, steps (a) through (f) schematically illustrate a presently preferred mode of practicing the electrophotographic luminescent amplification process of the present invention. The top portion of each step in FIG. 1 illustrates a photoconductor 10 and the process step performed thereon, and the bottom portion illustrates the voltage level V of the electrostatic charge pattern formed on the photoconductor as a function of a distance X along the photoconductor 10. In step (a), a photoconductor 10, having a filter layer 12 (described below) is charged by a corona charger 14 in a conventional manner, to produce a uniform voltage V across the photoconductor. In step (b), the charged photoconductor 10 is exposed to imagewise radiation 16 to produce a low amplitude differential voltage pattern $\delta V$ in the photoconductor. Next, in step (c), the low amplitude differential voltage pattern is developed with a luminescent toner to produce a luminescent toner image 18 on the surface of the photoconductor 10. The image may be developed using any of the known electrophotographic development techniques such as liquid, dry magnetic brush, or cloud development; however, liquid development is the presently preferred method. The luminescent material in the toner may comprise, for example luminescent pigments, dyed latices in which the dyes are luminescent or optical brighteners, luminescent metal chelates, or fluorescent polymers such as polymers containing fluorescing anthracene or other fluorescing units. For reasons that will become apparent below, to enhance the overall efficiency of the amplification process, the fluorescence of the toner is selected or tailored to match the action spectrum of the photoconductor 10.

Optionally, in step (d), the photoconductor 10 with the luminescent toner image in place is recharged. This recharging step is not essential to practice of the invention. The recharging may be to the same or different voltage and the same or opposite polarity, as required by the toner charge polarity or by the need for a positive or negative output representation of the original input information. Next, in step (e), the photoconductor 10 is uniformly illuminated with radiation 20 that excites the luminescent toner 18 to emit an imagewise pattern of radiation 22. Filter 12 is selected to block the exciting radiation 20 and to pass emitted radiation 22, so that the photoconductor 10 is discharged by the emitted radiation 22 to produce a high amplitude differential voltage pattern $\Delta V$ on the photoconductor. The filter layer, when exposed to the uniform radiation of step (e), must not luminesce significantly in the wavelength range where the photoconductor 10 is photoconductive.

Finally, in step (f), the high amplitude differential voltage pattern is developed to produce a high density image 24. The final development may be by any of the known development techniques and may employ the same or a similar type of fluorescent toner that was used to develop the low voltage differential image, or a different toner such as a conventional opaque toner. The high density toner image may be fixed in place on the photoconductor or transferred to a receiver as is known in the prior art. In the example shown, a positive corona charge was applied in steps (a) and (d), a positive luminescent toner was used in step (c), and a positive second toner was applied in step (f). This is known as a negative/positive process, with the final toner density corresponding to exposed areas in the original. As will be apparent to one skilled in the art, the image sense (negative/positive or positive/positive) can be selected by properly selecting the polarities of the primary charging voltage and the optional recharging voltage or by selecting the polarities of the charges on the toners.

Our theoretical and experimental studies of the electrophotographic luminescent amplification technique indicate that gains of between 10 and 30 times higher than those of conventional electrophotography can be achieved by this technique.

In a modification of the process described above, the photoconductor 10 and the luminescent toner are selected such that the photoconductor is transparent to the spectral range of radiation that is employed to excite the luminescent toner, and it photoconducts in response to the radiation emitted by the luminescent toner. With this arrangement, the filter 12 is not required. Alternatively, a composite photoconductor having a charge transport layer and a charge generation layer as is known in the art may be employed, and the filter 12 may be incorporated in the charge transport layer. This may be accomplished, for example by adding an appropriate nonfluorescent dye to a conventional charge transport layer.

In another modification of the process described above, the luminescent toner image produced in step (c) is transferred to a second photoconductor (not shown), and the second photoconductor is subjected to steps (d)–(f) as described above.

Figure 2:
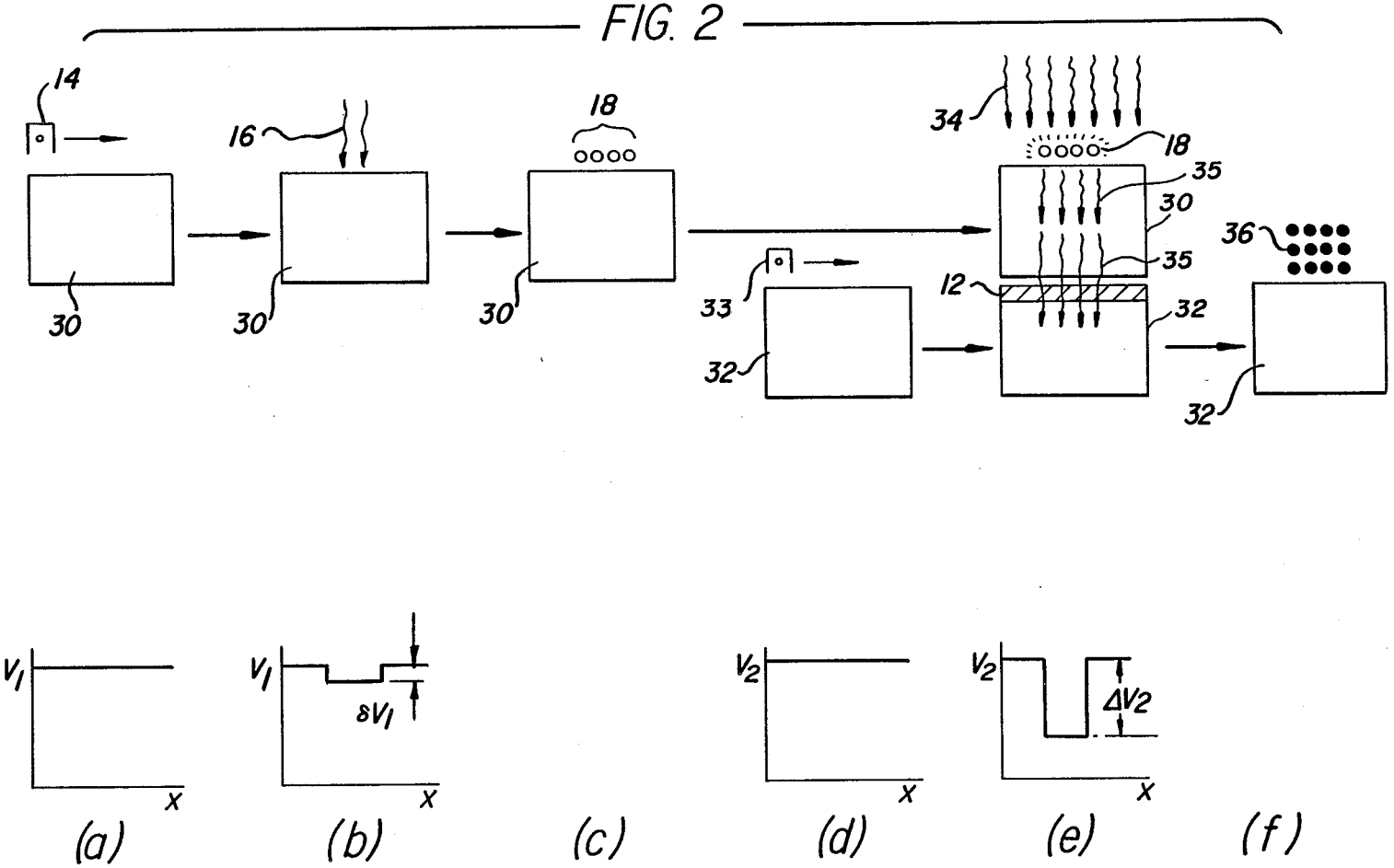
FIG. 2. is a schematic diagram illustrating the steps in an alternative mode of practicing the invention.

An alternative mode of practicing the present invention is illustrated in FIG. 2. The steps in FIG. 2 are illustrated in a manner similar to FIG. 1, with the top part of each step showing a photoconductor and the process operation performed thereon, and the bottom portion of the illustration of each step showing the voltage across the photoconductor in a direction X. In the first step (a), a first photoconductor 30 is charged by corona charger 14 to a uniform voltage $V_1$. In the next step (b), the charged photoconductor 30 is exposed to an imagewise pattern of low intensity radiation 16 to form a low amplitude differential voltage pattern $\delta V_1$. In step (c), the low amplitude differential voltage pattern is developed with a luminescent toner as described above, to produce a luminescent toner image 18. In step (d), a second photoconductor 32 is charged by corona charger 33 to produce a uniform voltage $V_2$ across the second photoconductor 32. Next, as illustrated by step (e), a second photoconductor 32 is placed in close proximity to the imagewise luminescent toner deposit 18 borne on first photoconductor 30, with a filter 12 between them. The luminescent toner image 18 on the first photoconductor 30 is uniformly illuminated with radiation 34 to excite the luminescent toner 18. The luminescent toner 18 and the photoconductor 30 are mutually selected such that the photoconductor 30 is substantially transparent to the emitted radiation 35 and, when excited by radiation 34 or 35, does not luminesce substantially at wavelengths to which the second photoconductor 32 is sensitive. A photoconductor that would luminesce when excited by radiation 34 can be rendered substantially nonluminescent by overcoating it with a suitable filter layer. Alternatively, the composition of the first photoconductor 30 can be selected to absorb radiation 34 without substantial luminescence, without use of a discreter filter layer. Filter 12 is selected to block any exciting radiation that passes through the first photoconductor 30 and to pass the radiation 35 emitted by the luminescent toner in response to the exciting radiation. Again, filter 12 must not luminesce substantially at wavelengths to which photoconductor 32 is sensitive. Alternatively, if the first photoconductor 30 is selected to pass emitted radiation 35 and absorb exciting radiation 34, filter 12 may not be required. As another alternative, the second photoconductor 32 can comprise separate charge generating and charge transporting layers susch as are well known in the art, except that the materials in the charge transporting layer are chosen to make that layer opaque to exciting radiation 34, nonluminescent at wavelengths to which the charge generating layer is sensitive, and transparent to emitted radiation 35. Again, filter 12 might not be required. If filter 12 is required, it may be a thin sheet separate from either photoconductor, or it may be overcoated on the first photoconductor 30, coated on the substrate of that photoconductor or incorporated in that substrate, or overcoated on the second photoconductor 32.

Continuing step (e), imagewise radiation 35 emitted from the luminescent toner 18 exposes the second photoconductor 32 to produce a high amplitude differential voltage pattern $\Delta V_2$. The high amplitude differential voltage pattern in photoconductor 32 is developed to produce a high density visible image 36.

In FIG. 2*e*, the front surface (corona charged) of the second photoconductor 32 faces the rear surface (substrate side) of the first photoconductor 30. In the practice of this invention, the two photoconductors may be in any of three other arrangements, according to whether the front or rear surface of the second photoconductor faces the front or rear surface of the first photoconductor. As will be obvious from the previous discussion of FIG. 2*e*, each arrangement has its own requirements as to the location of the filter layer or layers, with proper attention to the transparency and nonluminescence properties required of filters and of photoconductors (including their substrates). For instance, if the front surface of the first photoconductor faces either surface of the second photoconductor, the first photoconductor must be transparent to the exciting radiation and also be nonluminescent.

In another alternative arrangement, the first and second photoconductors 30 and 32 may be constructed as a unitary element. For example, the photoconductors could be formed on opposite sides of a single belt, with the filter layer in between, or incorporated in the belt. In this case, the secondary image would be formed on the opposite side of the unitary element from the first image.

Figure 3:
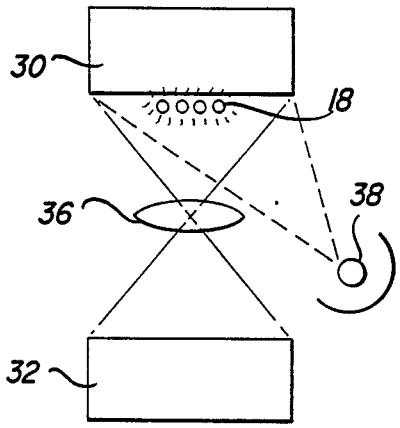
FIG. 3. is a schematic diagram illustrating the steps in a further alternative mode of practicing the invention.

FIG. 3 illustrates an alternative step (e) in FIG. 2. As shown in FIG. 3, the exposure of the second photoconductor by the luminescence from the luminescent toned image may be achieved by using optical imaging means to direct the emitted light onto the second photoconductor with a lens 36. Luminescence is excited by radiation from a lamp 38. Other optical imaging means may be employed to direct the emitted light onto the second photoconductor. Such optical imaging means include conventional lenses, Fresnel lenses, holographic lenses, mirrors, and combinations thereof. By use of such optical imaging means, the image on the second photoconductor can optionally be magnified or reduced in scale. Such optical imaging means may be selected to be opaque to the radiation that excites the luminescence of the toner, or a suitable filter may be incorporated into said optical imaging means, either as a filter layer coated on one or more optical elements or as a separate element.

In yet another mode of practicing the present invention, a luminescent toned image is formed as in steps (a)–(c) in FIG. 2 and then transferred to a suitable receiver sheet and, optionally, fused thereto. This receiver sheet would take the place of the first photoconductor 30 in step (e) of FIG. 2 or in the alternative step (e) illustrated in FIG. 3. When an intermediate receiver sheet is thus used, the first photoconductor may optionally be reused to form the secondary, high amplitude differential voltage pattern and the final high density image.

In a further mode of practicing the present invention, the first, luminescent toner image may be formed by a photoelectrophoretic imaging process. In one version of this mode, a dispersion of charged, luminescent toner particles is exposed to a pattern of imagewise radiation while an electric field is applied. A photoconductor is used as a receiver on which photoactivated toner particles are deposited imagewise. The photoconductive receiver, with the toner in place, is subsequently charged as necessary, and the luminescent toner image is excited to emit radiation that produces a high amplitude voltage pattern in the photoconductor. This voltage pattern is then developed by conventional means. In one version of this mode, the photoconductor is provided with a filter layer that blocks the radiation used to excite the luminescence of the toner but transmits that luminescence. In another version, the photoconductor is transparent to the exciting radiation, and no filter is required.

In another photoelectrophoretic mode of practicing the present invention, the photoelectrophoretic image is formed on a receiver sheet that need not be photoconductive, and luminescence from that image is used to produce a high amplitude differential voltage pattern on a charged photoconductor.

As yet further modes of practicing the present invention, the first luminescent toner image may be produced as the output of any other electrographic process known in the art in which a charge, voltage, current or conductivity pattern is developed by charged toner particles to produce a visible or optically detectable image.

Each embodiment may also be used to generate multiple secondary images, for example, by repeatedly producing and transferring the high density toned image from the photoconductor on which is formed to a receiver such as paper or a transparent plastic sheet. The luminescent tone image may be fused to the photoconductor or receiver that bears it to protect it from disturbance.

EXAMPLES

Example 1

A photoconductor suitable for use as the first photoconductor (10) in FIG. 1 or the second photoconductor (32) in FIG. 2, employing a built-in filter lyaer, was prepared as follows. A milti-active photoconductor of the type described in U.S. Pat. No. 4,175,960, issued Nov. 27, 1979 to Berwick et al., was prepared on a transparent polyethylene terephthalate support bearing a semitransparent (0.4 optical density) nickel conductive layer. It was overcoated with a solution containing 0.19 grams of the ultraviolet absorbing and substantially nonfluorescent dye $(HO—CH_2CH_2)_2N—CH=CH—CH=C(CN)_2$, 1.0 grams of the binder cellulose acetate butyrate, and 22 ml of methanol, using a 0.0015 inch draw knife and a substrate temperature of approximately 50° C., and then allowed to dry thoroughly. (The synthesis of the dye is described in Deutsche Offenlegungsschrift DE3,505,423 Al by J. Sobel et al.). A similar coating on a transparent sheet of Estar TM polyester film base had an optical density exceeding 2 between 350 and 400 nm and was substantially transparent at wavelengths greater than 420 nm. The overcoated multi-active photoconductor could be discharged from an initial surface potential of −600 V to a final surface potential of −300 V by 3.4 ergs/cm$^2$ of 550 nm light, but the same discharge required 905 ergs/cm$^2$ for irradiation at 375 nm. The relative insensitivity to 375 nm ultraviolet light indicates that the filter layer, thus prepared, effectively blocked the ultraviolet radiation and did not luminesce substantially. The sensitivity was high at 550 nm, in part because the filter layer was transparent there.

A second photoconductor with a built-in filter layer was prepared by overcoating a green-sensitive film (KODAK EKTAVOLT Film SO—435) with a solution containing 0.22 grams of the dye $(HO—CH_2CH_2)_2N—CH=CH—CH=C(CN)_2$, 2.2 grams of cellulose acetate butyrate, and 25 ml of methanol, using a 0.003 inch draw knife.

An auxiliary filter was prepared by overcoating Estar TM polyester film base with the same solution used to overcoat the multi-active photoconductor, using a 0.003 inch draw knife. The optical density exceeded 2 for ultraviolet light of wavelengths between 340 and 400 nm and was less than 0.1 for visible wavelengths greater than 418 nm.

Example 2

A fluorescent zinc chelate having the structure

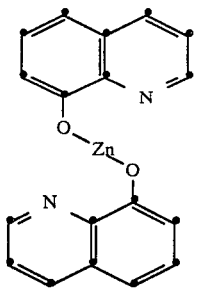

was prepared as follows. A hot solution containing 48 grams of $ZnSO_4 7{\cdot}H_2O$ and approximately 130 ml of water was added with stirring to a solution containing 48.5 grams of 8-quinolinol, 21 ml of glacial acetic acid, and approximately 200 ml of denatured ethanol. The resulting solution was stirred an additional 5 minutes with heating to approximately 60° C. Then 56 ml of 28% $NH_4OH$ was added. The solid zinc chelate was collected by filtration and washed, in order, with ethanol, water, and acetone and dried four hours at 60° C. in a partial vacuum of 0.03 atmosphere.

A first luminescent developer of composition similar to those described in U.S. Pat. No. 3,788,995, issued Jan. 29, 1974 to Stahly and Merrill, was prepared as follows. A concentrate was first prepared from 0.8 grams of poly(t-butylstyrene-co-lithium methacrylate), 97:3 by weight, 1 gram of the zinc chelate, and 15.2 grams of SOLVESSO 100 by milling for 7 days in a ball mill. (SOLVESSO 100 is a cyclohydrocarbon having a major aromatic component and having a boiling range of from about 150 to about 185° C., sold by Humble Oil and Refining Co.). A solution containing 1.14 grams of poly (ethyl acrylate-co-ethyl methacrylate-co-lauryl methacrylate-co-lithium sulfoethyl methacrylate), 46:26:16:12 by weight, and 10 grams of SOVESSO 100 was added to this concentrate. The resulting concentrate was diluted with a liter of ISOPAR G under high ultrasonic shear. (ISOPAR G is an isoparaffinic hydrocarbon having a boiling range of from about 145° C. to about 185° C., sold by EXXON Corporation). When this developer was used to develop a conventional electrophotographic image, the toner exhibited a luminescence peaking at 500 nm, near the wavelengths of maximum photosensitivity for the green sensitive film used in Example 1.

A second luminescent developer was made similar to the first, except that the zinc chelate was prepurified by sublimation using argon as an entrainer gas.

Example 3

A low amplitude differential voltage pattern was formed on a first photoconductor, KODAK EKTAVOLT Film SO—101, and developed with a luminescent toner according to the following steps, which are described with reference to FIG. 2.

(a) The film 30 was corona charged to ±50 volts, (b) The charged film was exposed to white light through a test pattern containing transparent squares on an opaque background for 3 seconds to completely discharge the areas of the photoconductor corresponding to the transparent squares of the test pattern, (c) The resulting low amplitude differential voltage pattern was developed for 20 second in the second luminescent developer described in Example 2, rinsed in ISOPAR G, and dried with heated air.

A high amplitude differential voltage pattern and a high density image were produced from the luminescent toned image 18 as follows. The arrangement shown in part (e) of FIG. 2 was reproduced, using the overcoated multi-active photoconductor and auxiliary filter described in Example 1 as the second photoconductor 32 and the filter 12, respectively. The filter layer overcoated on the multi-active photoconductor is not shown separately and may be regarded as part of filter 12. The exciting radiation 34 was the long-wave ultraviolet (UV) from a MINERALIGHT UVSL-58 lamp (manufactured by Ultra-Violet Products, Inc. of San Gabriel, California), passed through, in order, a KODAK SRATTEN Ultraviolet Filter Number 18A to remove visible light and an ORIEL Low-Fluorescence Filter No. 5215 to remove shorter wave ultraviolet light. The UV illumination caused the luminescent toner to emit green light imagewise, which discharged the second photoconductor to form a high amplitude differential voltage pattern. In areas where there was no luminescent toner, the UV illumination was absorbed by the first photoconductor, the auxiliary filter, and the overcoat on the second photoconductor. The UV exposure lasted about 390 seconds. Thereafter, the image on the second photoconductor was developed by dipping the photoconductor for about 20 seconds in the liquid developer described above, then blow dried with heated air.

Under uniform long-wave UV illumination, the resulting developed image on the second photoconductor appeared to have approximately twice the luminescent intensity of the developed luminescent toner image on the first photoconductor, and the background of the second image was very clean.

Example 4

The procedure of Example 3 was repeated, except that the auxiliary filter between the first and second photoconductors was omitted and the UV exposure lasted 435 seconds. The developed second image had approximately the same luminescent intensity as that obtained in Example 3. This example demonstrated that sufficient UV blockage was provided by the first photoconductor and the overcoat on the second photoconductor. Multiple second copies were made from the first image to demonstrate the utility of the process for making multiple copies of the image.

Example 5

A first luminescent image was prepared as described in Example 3 except that the first photoconductor was charged to 30 volts rather than 50 volts. A green sensitive photoconductive film (KODAK EKTAVOLT Film SO-435), having no UV-blocking overcoat, was used as the second photoconductor in the same arrangement as in Example 3. The green sensitive film was charged to ±600 volts and exposed to the imagewise radiation emitted from the first luminescent toned image, which was excited by a 300 second exposure to the long wavelength UV radiation. The second photoconductor was developed by dipping into a conventional carbon-containing liquid developer for 15 seconds, followed by drying with heated air. As a comparative sample, a second sheet of the first photoconductor film was charged to ±30 volts, exposed to the same test pattern, and developed with the same carbon-containing liquid developer.

The secondary, amplified image produced by luminescence of the primary toner image appeared to have much higher density than the comparative image prepared by conventional means. To measure the densities of these images quantitively, the images were fused in place on the photoconductive films at 95° C. for 10 seconds. Red transmission density was measured and corrected for the density of the untoned film to obtain the density of the toner in the dark squares ($D_{max}$) and in the light background areas ($D_{min}$) of both images. Average values are reported in Table I, along with the density gain defined as $D_{max}-D_{min}$ for the amplified image divided by $D_{max}-D_{min}$ for the comparative image.

TABLE I

| | Amplified Image | Comparative Image |
|---|---|---|
| $D_{min}$ | 0.16 | 0.02 |
| $D_{max}$ | 0.84 | 0.17 |
| Gain | 4.4 | |

In addition to the density gain demonstrated, this example illustrates that adequate blockage of the UV illumination can be achieved without a UV-blocking overcoat on the second photoconductor.

Example 6

The second, green sensitive overcoated photoconductor described in Example 1 was charged to ±30 volts, exposed through the test pattern to produce a low amplitude differential voltage pattern of amplitude 30 volts, developed with the first luminescent toner described in Example 2, rinsed in ISOPAR G, and dried with hot air. The photoconductor with the luminescent toned image in place was recharged to ±600 volts and exposed from the toned image side for 5 seconds to the long-wave UV light source arrangement as in Example 3 to cause the toned image to luminesce and generate a high amplitude differential voltage pattern in the photoconductor. The high amplitude differential voltage pattern was developed by dipping in conventional carbon-containing liquid developer for 15 seconds and dried. The resulting back image had an average transmission density contrast, ($D_{max}$—$D_{min}$), of 0.50.

For comparison, a second sample of the same overcoated photoconductor was charged and exposed in the same manner as the first exposure described above, to generate a low amplitude differential voltage pattern. The image was developed by dipping in the conventional carbon-containing developer for 15 seconds and dried. The resulting image had a contrast of 0.15. This example illustrates that a single photoconductor can be employed for both the imagewise primary and the blanket secondary exposure steps in the amplification process of the present invention.

Example 7

A low-amplitude differential voltage pattern was formed and developed as in Example 1 except the film was charged to ±10 volts and exposed for 4 seconds (to discharge it in exposed areas completely) and developed by dipping for 15 seconds in the first developer described in Example 2. The green sensitive photoconductor (KODAK EKTAVOLT Film SO—435) was used to form a high amplitude differential voltage image by the same method as in Example 1 except that this second photoconductor was charged to ±600 volts, the ORIEL 5215 filter was omitted and the UV illumination lasted 10 seconds. The image on the second photoconductor was developed by dipping a conventional carbon-containing developer for 15 seconds and drying. The resulting toned image had $D_{max}$=0.76 and $D_{min}$=0.03, where $D_{max}$ and $D_{min}$ are still defined as in Example 5.

A comparative image was formed on another piece of the same, green-sensitive photoconductor by charging it to ±10 volts and exposing it to white light through the test pattern for 1 second to discharge it in exposed areas completely, then developing it with the same carbon-containing developer and in the same manner as the previous image. The resulting comparative image had $D_{max}$=0.07 and $D_{min}$=0.02. Accordingly, the density gain due to the luminescent amplification process was 14. It is immaterial that the first photoconductor used in the amplification process was not the same as that used in the conventional electrophotographic process since the amplitudes of the differential voltage patterns were both 10 volts.

Advantages

The present invention is advantageous in that it provide improved gain in an electrophotographic imaging process as compared to the conventional electrophotographic process. The improved amplification is useful in reducing the exposure required for producing a diagnotically useful image in exeroradiography. The improved amplification can also be employed to advantage to increase the speed of conventional photoconductors and to extend the useful spectral range of photoconductors. For example, a conventional photoconductor, designed for efficient exposure in the visible region of the spectrum, could by the process of the present invention be employed to record IR or UV exposure where the absorption of the photoconductor may be weak. The process of the present invention may also be used to offset the low quantum efficiency of a low dye concentration photoconductor. The low dye photoconductor would be more economical to manufacture. Such low dye photoconductors would appear substantially transparent, a feature that is often desirable when the final image is to be fixed and retained on the photoconductor itself. The invention may also be employed to produce multiple copies from a single low exposure.

The present invention is also advantageous in that it provides improved sensitivity in other electrographic processes, including photoelectrophoresis, ionography, stylus recording and ion projection, or in any related process in which a charge, voltage, current or conductivity pattern is developed by charged toner particles to produce a visible or optically detectable image.

We claim:

1. A method of amplifying an electrophotographic image, comprising the steps of:
   a. providing a photoconductor having a filter for passing radiation of first and second wavelengths and blocking radiation of a third wavelength;
   b. uniformly charging the photoconductor;
   c. imagewise exposing the charged photoconductor with radiation of the first wavelength to produce a low amplitude differential voltage pattern;
   d. developing the low amplitude differential voltage pattern with a luminescent toner that is excitable by radiation of the third wavelength to emit radiation of the second wavelength to form a luminescent toner image;
   e. recharging the photoconductor as necessary;
   f. exciting the luminescent toner image to emit radiation that produces a high amplitude differential voltage pattern in the photoconductor; and
   g. developing the high amplitude differential voltage pattern to form a high density image.

2. A method of amplifying an electrophotographic image, comprising the steps of:
   a. providing a first photoconductor that is transparent to radiation of a first wavelength;
   b. imagewise exposing the first photoconductor to produce a low amplitude differential voltage pattern;
   c. developing the low amplitude differential voltage pattern with a luminescent toner that is excitable by radiation of the first wavelength to emit radiation of a second wavelength to produce a luminescent toner image;
   d. closely contacting the luminescent toner image on the first photoconductor with a second photoconductor covered by a filter for blocking said first wavelength and passing said second wavelength of radiation;
   e. uniformly exposing the developed image with radiation of said first wavelength through said first photoconductor to cause said luminescent toned image to emit imagewise radiation of said second wavelength to produce a high amplitude differential voltage pattern on said second photoconductor; and
   f. developing the high amplitude differential voltage pattern to produce a high density image.

3. The method claimed in claim 2, wherein multiple copies of the high density image are made by repeating steps d, e, and f.

4. The method claimed in claim 3, further comprising the step of fusing the luminescent toner image to the first photoconductor after step (c).

5. The method claimed in claim 3, further comprising the step of transferring the luminescent toner image to a receiver after step (c).

6. The method claimed in claim 5, further comprising the step of fusing the luminescent toner image to the receiver.

7. A method of amplifying an image, comprising the steps of:
   a. electrographically forming a luminescent toner image;
   b. exciting the luminescent toner image to produce emitted radiation;
   c. exposing a photoconductor by the emitted radiation to produce a differential voltage pattern in said photoconductor; and
   d. developing the differential voltage pattern to produce the amplified image.

8. The method claimed in claim 7, wherein said exposing step employs optical imaging means to produce magnification by a factor greater, equal, or less than unity.

9. The method claimed in claim 7, wherein said exposing step employs filter means for passing emitted radiation and blocking exciting radiation.

10. The method claimed in claim 8, wherein said optical imaging means is a lens.

11. The method claimed in claim 8, wherein said optical imaging means if a mirror.

12. The method claimed in claim 7, wherein said step of electrographically forming a luminescent toner image comprises photoelectrophoresis.

13. The method claimed in claim 1 or 2, wherein said step of forming a low amplitude differential voltage pattern comprises exposing the photoconductor with X-rays.

14. The method claimed in claim 7, wherein said step of electrographically forming a luminescent toner image utilizes ionography as the means for producing the charge pattern to be toned.

15. The method claimed in claim 7, wherein said step of electrographically forming a luminescent toner image utilizes photoelectrophoresis as the means.

16. The method claimed in claim 7, wherein said step of electrographically forming a luminescent toner image utilizes ion projection as the means for producing the charge pattern to be toned.

17. The method claimed in claim 7, wherein said step of electrographically forming a luminescent toner image utilizes stylus recording as the means for producing the charge pattern to be toned.

18. The method claimed in claim 7 further comprising the step of transferring the luminescent toner image to a receiver prior to step b.

19. The method claimed in claim 18 further comprising the step of fusing the luminescent toner image to the receiver.

* * * * *